US009279651B1

(12) United States Patent
Goldberg

(10) Patent No.: US 9,279,651 B1
(45) Date of Patent: Mar. 8, 2016

(54) LASER-GUIDED PROJECTILE SYSTEM

(71) Applicant: Marshall Phillip Goldberg, Coos Bay, OR (US)

(72) Inventor: Marshall Phillip Goldberg, Coos Bay, OR (US)

( * ) Notice: Subject to any disclaimer, the term of this patent is extended or adjusted under 35 U.S.C. 154(b) by 0 days.

(21) Appl. No.: 14/830,048

(22) Filed: Aug. 19, 2015

Related U.S. Application Data

(60) Provisional application No. 62/047,890, filed on Sep. 9, 2014.

(51) Int. Cl.

| | |
|---|---|
| ***F42B 10/60*** | (2006.01) |
| ***F42B 10/66*** | (2006.01) |
| ***F42B 30/02*** | (2006.01) |
| ***F42B 5/02*** | (2006.01) |
| ***F41G 7/24*** | (2006.01) |
| ***F42B 15/01*** | (2006.01) |
| ***F41G 7/26*** | (2006.01) |

(52) U.S. Cl.
CPC . *F42B 15/01* (2013.01); *F41G 7/24* (2013.01); *F41G 7/263* (2013.01); *F41G 7/266* (2013.01); *F42B 10/60* (2013.01); *F42B 10/66* (2013.01); *F42B 30/02* (2013.01); *F42B 5/02* (2013.01)

(58) Field of Classification Search
CPC ..... F42B 10/00; F42B 10/02; F42B 10/60; F42B 10/66; F42B 10/661; F42B 10/663; F42B 15/00; F42B 15/01; F42B 30/00; F42B 30/02; F42B 30/08; F42B 5/02; F42B 5/10; F42B 5/145; F41G 7/24; F41G 7/263; F41G 7/266
USPC ..... 102/430, 439, 441, 501, 516, 517, 201; 42/113, 114, 115, 117; 244/3.13; 89/1.1, 1.11
See application file for complete search history.

(56) References Cited

U.S. PATENT DOCUMENTS

| | | | | | |
|---|---|---|---|---|---|
| 3,398,918 | A * | 8/1968 | Girault | F41G 7/7263 244/3.13 |
| 3,860,199 | A | 1/1975 | Dunne | |
| 4,176,814 | A * | 12/1979 | Albrektsson | F41G 7/222 244/3.15 |
| 4,408,735 | A * | 10/1983 | Metz | B64C 15/14 244/3.16 |

(Continued)

FOREIGN PATENT DOCUMENTS

| | | | | |
|---|---|---|---|---|
| DE | 2500232 | A1 * | 7/1976 | F41G 7/266 |
| EP | 0371007 | | 5/1990 | |

OTHER PUBLICATIONS

Max Slowik Jul. 12, 2014 Filed under: Military, Product & Industry News Check out DARPA's EXACTO system: Laser-guided .50 bullets in action.

(Continued)

*Primary Examiner* — James S Bergin

(57) ABSTRACT

A laser-guided projectile system is a system for correcting the external and internal ballistic factors that affect the flight trajectory of a projectile that is traveling to a target. A laser tunnel generator assembly and a housing sleeve are mounted to a barrel of a firearm. A laser tunnel is projected forward from the firearm and the projectile is able to travel within the laser tunnel. When the projectile comes into contact with the laser tunnel due to ballistic factors, a plurality of explosive outputs is generated and the projectile is directed back toward the center of the laser tunnel. The plurality of explosive outputs is evenly distributed about an aerodynamic portion of the projectile to allow the plurality of explosive outputs to correct the flight trajectory, regardless of the portion of the projectile that comes into contact with the laser tunnel.

13 Claims, 15 Drawing Sheets

(56) References Cited

U.S. PATENT DOCUMENTS

| | | | | |
|---|---|---|---|---|
| 4,441,670 | A | 4/1984 | Crepin | |
| 4,537,371 | A | 8/1985 | Lawhorn | |
| 4,728,057 | A * | 3/1988 | Dunne | F42B 10/661 244/3.11 |
| 4,951,901 | A * | 8/1990 | Dunne | F42B 10/661 244/3.11 |
| 5,647,558 | A | 7/1997 | Linick | |
| 5,788,178 | A | 8/1998 | Barrett, Jr. | |
| 6,422,507 | B1 | 7/2002 | Lipeles | |
| 6,474,593 | B1 | 11/2002 | Lipeles | |
| 6,766,979 | B2 * | 7/2004 | Horwath | F41G 7/222 244/3.16 |
| 6,817,569 | B1 * | 11/2004 | Horwath | F41G 7/222 244/3.17 |
| 7,781,709 | B1 | 8/2010 | Jones | |
| 7,898,153 | B2 | 3/2011 | Barrett | |
| 7,963,442 | B2 | 6/2011 | Jenkins | |
| 7,999,212 | B1 | 8/2011 | Tiesen | |
| 8,084,725 | B1 | 12/2011 | Dryer | |
| 8,288,698 | B2 * | 10/2012 | Seidensticker | F41G 7/266 244/3.1 |
| 8,362,408 | B2 | 1/2013 | Carlson | |
| 8,558,151 | B2 | 10/2013 | Seidensticker | |

OTHER PUBLICATIONS

Ron Barrett, Ryan Barnhart; Richard Bramletter; Proc. SPIE 8341, Active and Passive Smart Structures and Integrated Systems 2012, 83410Z (Apr. 26, 2012): doi:10.1117/12.91.

* cited by examiner

SECTION B-B

LASER-GUIDED PROJECTILE SYSTEM

The current application claims a priority to the U.S. Provisional Patent application Ser. No. 62/047,890 filed on Sep. 9, 2014.

FIELD OF THE INVENTION

The present invention relates generally to a system for guiding a projectile to a target. More specifically, the present invention is a laser-guided projectile system that adjusts the flight trajectory of a discharged projectile by correcting all external and internal ballistic factors that affect the flight trajectory of the projectile.

BACKGROUND OF THE INVENTION

The flight trajectory of a projectile that has been discharged from a firearm is affected by a large number of factors. Gravity causes the projectile to descend while traveling to a target in an effect known as bullet drop. The projectile also experiences deceleration due to drag while traveling to the target. Crosswinds can also significantly alter the flight trajectory of the projectile, particularly over large distances. Ambient air density is an additional factor that must be taken into consideration. Many of the external ballistics of a projectile are variable environmental factors and are difficult to compensate for. As such, striking a target from a significant distance is a feat that requires extensive training, experience, and talent. The importance of a properly aimed shot is paramount as poorly aimed shots can result in collateral damage or danger to the shooter from enemy/adversary return fire.

Current technology introduces projectiles that feature complex internal propulsion, guidance, and control systems. However, this technology is expensive as well as difficult to implement. In addition, because these propulsion, guidance, and control systems are integrated into the projectile itself, the technology cannot be utilized with existing firearms and projectiles. Therefore, the object of the present invention is to provide a laser-guided projectile. The present invention is a laser-guided projectile system for correcting external and internal ballistic factors that affect the flight trajectory of a projectile after the projectile has been discharged from a firearm.

DETAIL DESCRIPTIONS OF THE INVENTION

Figure 1:
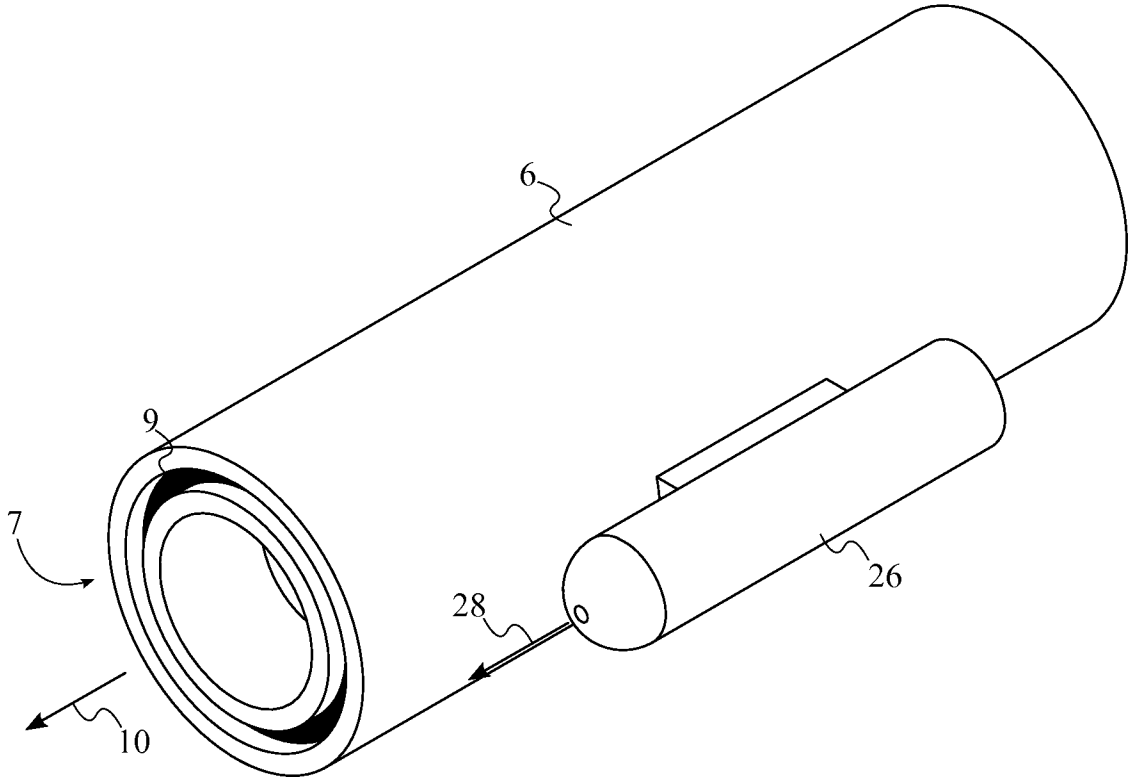
FIG. 1 is a perspective view of the housing sleeve, the laser tunnel generator assembly, and the calibration laser.
Figure 2:
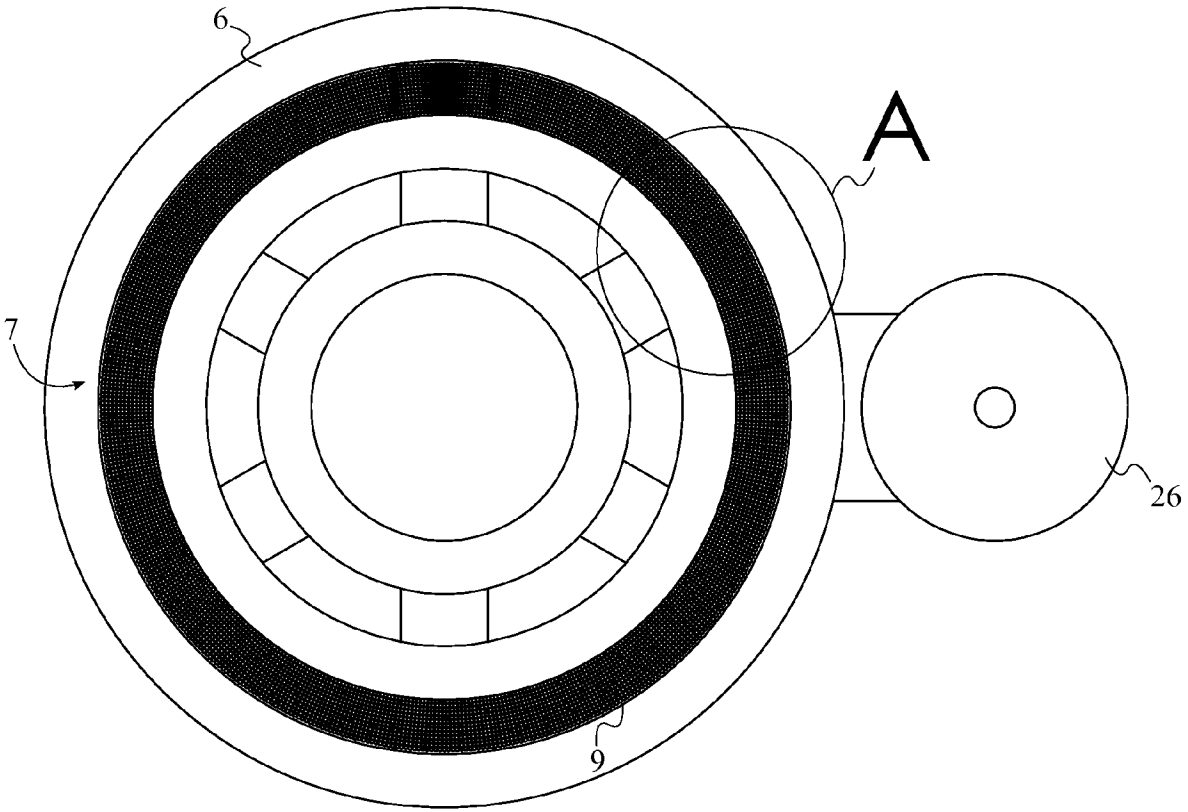
FIG. 2 is a front view of the housing sleeve, the laser tunnel generator assembly, and the calibration laser.
Figure 3:
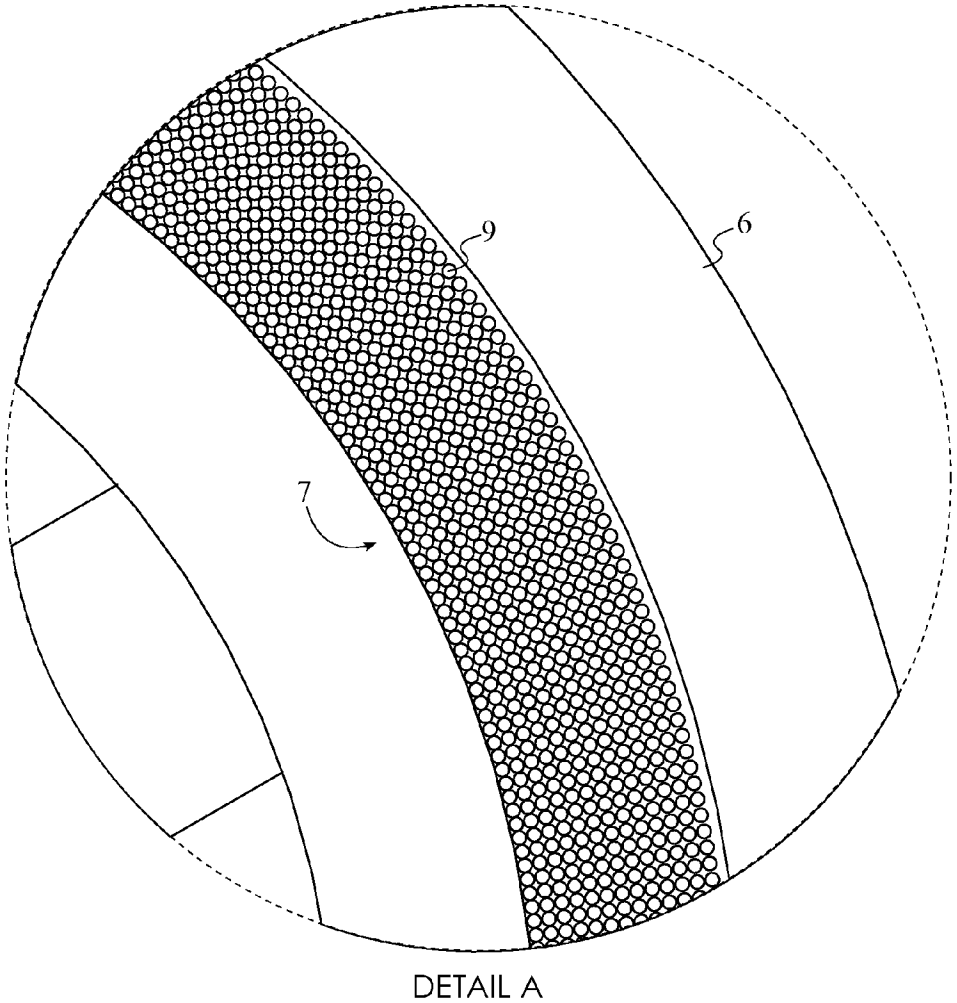
FIG. 3 is a detail view of the fiber optic dispersion array taken from circle A of FIG. 2.
Figure 4:
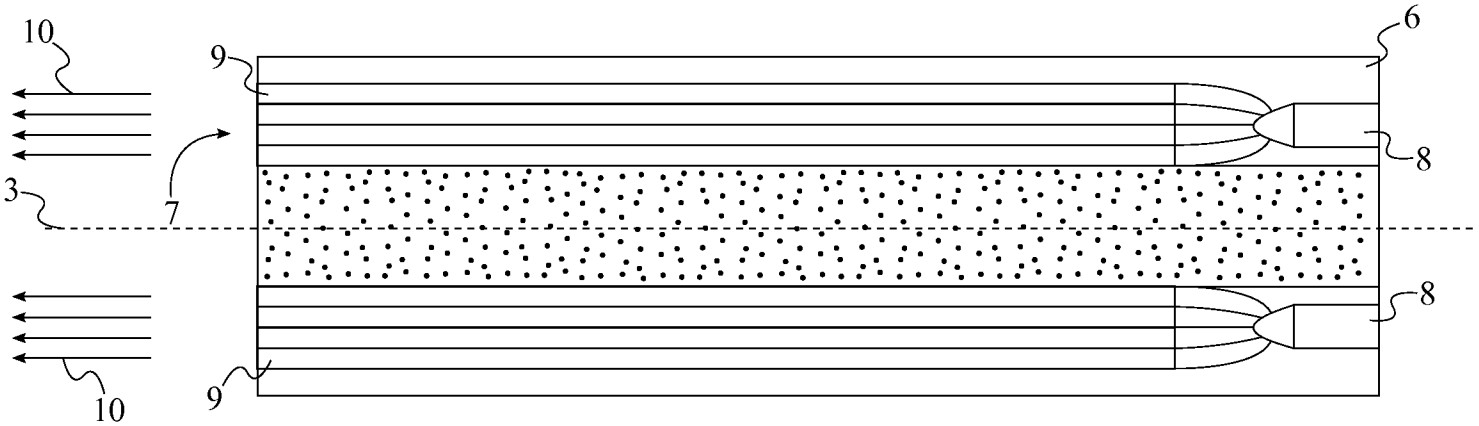
FIG. 4 is a diagrammatic view of the laser tunnel generator assembly within the housing sleeve.
Figure 5:
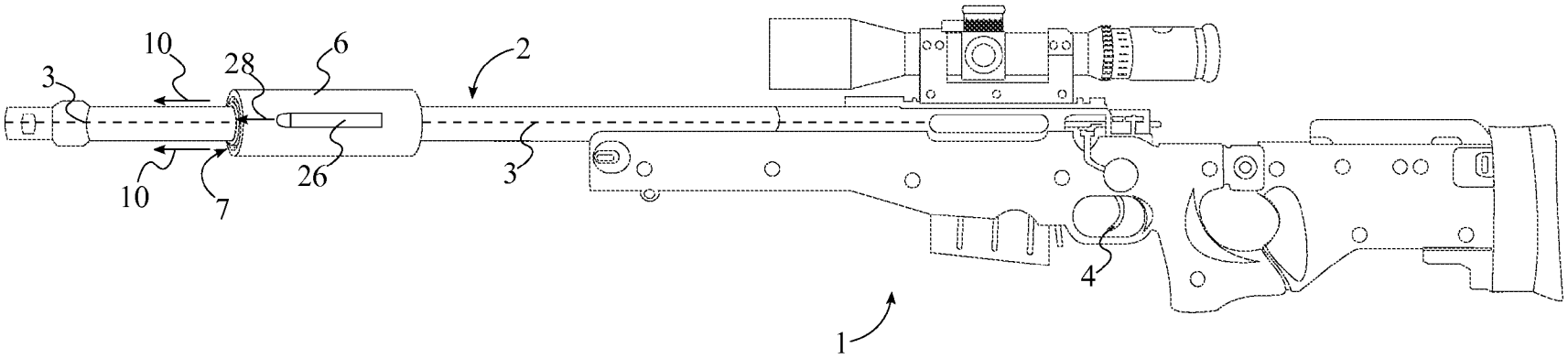
FIG. 5 is a side view of the firearm with attached housing sleeve and laser tunnel generator assembly.
Figure 6:
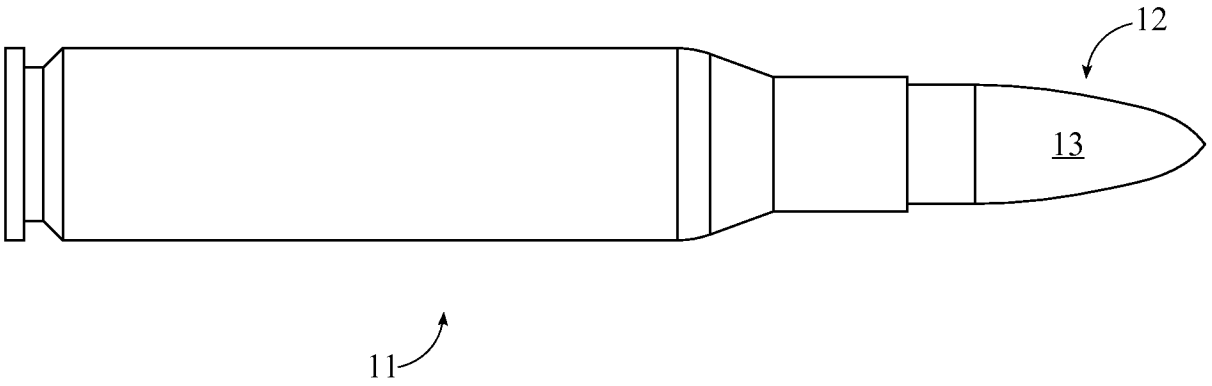
FIG. 6 is a side view of the cartridge.

All illustrations of the drawings are for the purpose of describing selected versions of the present invention and are not intended to limit the scope of the present invention.

The present invention is a laser-guided projectile system that is able to adjust the flight trajectory of a projectile by correcting the external and internal ballistic factors that affect the flight trajectory of the projectile. The present invention is shown in FIGS. 1-7 and comprises a firearm 1, a housing sleeve 6, a laser tunnel generator assembly 7, a cartridge 11, and a trajectory-correcting actuator 15. The cartridge 11 comprises a projectile 12 that is discharged from the firearm 1. The firearm 1 is preferably a long-barrel firearm such as a rifle to provide sufficient space for the housing sleeve 6. The firearm 1 is additionally preferably equipped with a scope that is capable of detecting both infrared light and visible light. The housing sleeve 6 contains and protects the components of the laser tunnel generator assembly 7. As such, the laser tunnel generator assembly 7 is positioned within the housing sleeve 6. The housing sleeve 6 is concentrically mounted to a barrel 2 of the firearm 1. Additionally, the cartridge 11 is concentrically positioned along a central axis 3 of the barrel 2. This allows the laser tunnel generator assembly 7 to emit a laser tunnel that is concentric to the barrel 2 of the firearm 1, allowing the projectile 12 to travel within the laser tunnel after being discharged from the firearm 1. The laser tunnel generator assembly 7 creates a laser tunnel through which the projectile 12 travels during flight to a target. The trajectory-correcting actuator 15 is engaged upon the projectile 12 coming into contact with the laser tunnel due to external and internal ballistic factors that alter the flight trajectory of the projectile 12. Once engaged, the trajectory-correcting actuator 15 is able to maintain the desired flight trajectory of the projectile 12 until the projectile 12 reaches the target.

The laser tunnel generator assembly 7 comprises an at least one laser diode 8 and a fiber optic dispersion array 9. The at least one laser diode 8 emits a laser through electromagnetic radiation that is of a required intensity, wavelength, and duration to engage the trajectory-correcting actuator 15 upon the projectile 12 coming into contact with the laser tunnel. The at least one laser diode 8 is preferably a steady state laser diode.

The fiber optic dispersion array 9 is able to direct the light from the at least one laser diode 8 in order to form a laser tunnel. The at least one laser diode 8 is optically connected into the fiber optic dispersion array 9 to allow the light from the at least one laser diode 8 to be directed into the fiber optic dispersion array 9.

The fiber optic dispersion array 9 preferably consists of multiple fiber optic strands that are arranged in a manner such that the fiber optic dispersion array 9 is able to form a continuous laser tunnel that is emitted from the laser tunnel generator assembly 7. The laser tunnel is formed by laser energy that forms a continuous conduit through which the projectile 12 is able to travel. An emission direction 10 of the fiber optic dispersion array 9 is oriented parallel to the central axis 3 of the barrel 2. This orients the fiber optic dispersion array 9 in a manner such that the laser tunnel is emitted away from the firearm 1 in the direction of flight after the projectile 12 is discharged from the firearm 1. The fiber optic dispersion array 9 is laterally positioned around the barrel 2 in order to allow the laser tunnel to form when the laser tunnel generator assembly 7 is activated. In the preferred embodiment of the present invention, the fiber optic dispersion array 9 is arranged circularly to form a cylindrical laser tunnel through which the projectile 12 travels after being discharged from the firearm 1. However, alternative arrangements of the fiber optic dispersion array 9 may allow for additional designs for the laser tunnel. The fiber optic dispersion array 9 may additionally allow for varying sizes of the laser tunnel. It is important to note that the size of the laser tunnel directly impacts the corresponding size of the impact zone on the target.

A plurality of explosive outputs 16 is able to physically alter the flight trajectory of the projectile 12 when the projectile 12 comes into contact with the laser tunnel. Selected outputs from the plurality of explosive outputs 16 on the aerodynamic portion 13 of the projectile 12 that come into contact with the laser tunnel physically move the projectile 12 back toward the center of the laser tunnel. The outputs that are selected from the plurality of explosive outputs 16 depend on which embodiment of the present invention is utilized for the present invention. The plurality of explosive outputs 16 for the trajectory-correcting actuator 15 is evenly distributed about an aerodynamic portion 13 of the projectile 12, allowing the plurality of explosive outputs 16 to correct the flight trajectory of the projectile 12, regardless of which portion of the projectile 12 comes into contact with the laser tunnel. The plurality of explosive outputs 16 provides an instantaneous and short-lived counterforce that directs the projectile 12 back toward the center of the laser tunnel. It is important that the plurality of explosive outputs 16 is instantaneous and short-lived due to the spin experienced by the projectile 12 during flight.

Figure 7:
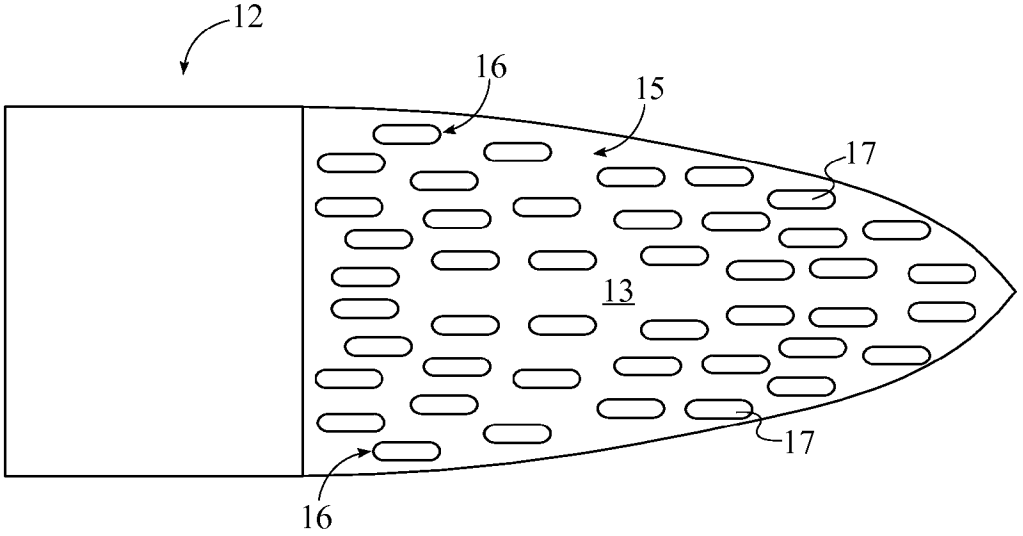
FIG. 7 is a diagrammatic view of an embodiment of the present invention, wherein the plurality of laser-combustible microcapsules is externally layered onto the aerodynamic portion of the projectile.

As shown in FIG. 7, the trajectory-correcting actuator 15 comprises a plurality of laser-combustible microcapsules 17. The plurality of laser-combustible microcapsules 17 generates the plurality of explosive outputs 16 when the projectile 12 comes into contact with the laser tunnel, thus correcting the flight trajectory of the projectile 12. In this first embodiment of the trajectory-correcting actuator 15, the plurality of laser-combustible microcapsules 17 is externally layered onto the aerodynamic portion 13 of the projectile 12, essentially forming a coating of the plurality of laser-combustible microcapsules 17 on the projectile 12. As such, when the projectile 12 comes into contact with the laser tunnel, the plurality of laser-combustible microcapsules 17 is engaged by the laser tunnel, generating the plurality of explosive outputs 16 that corrects the flight trajectory of the projectile 12, directing the projectile 12 back toward the center of the laser tunnel. In the first embodiment of the plurality of laser-combustible microcapsules 17, the plurality of laser-combustible microcapsules 17 is preferably bonded to the aerodynamic portion 13 of the projectile 12 in a manner such that the plurality of laser-combustible microcapsules 17 is not rubbed off, activated, or otherwise displaced or disturbed during handling and discharge of the projectile 12.

Figure 8:
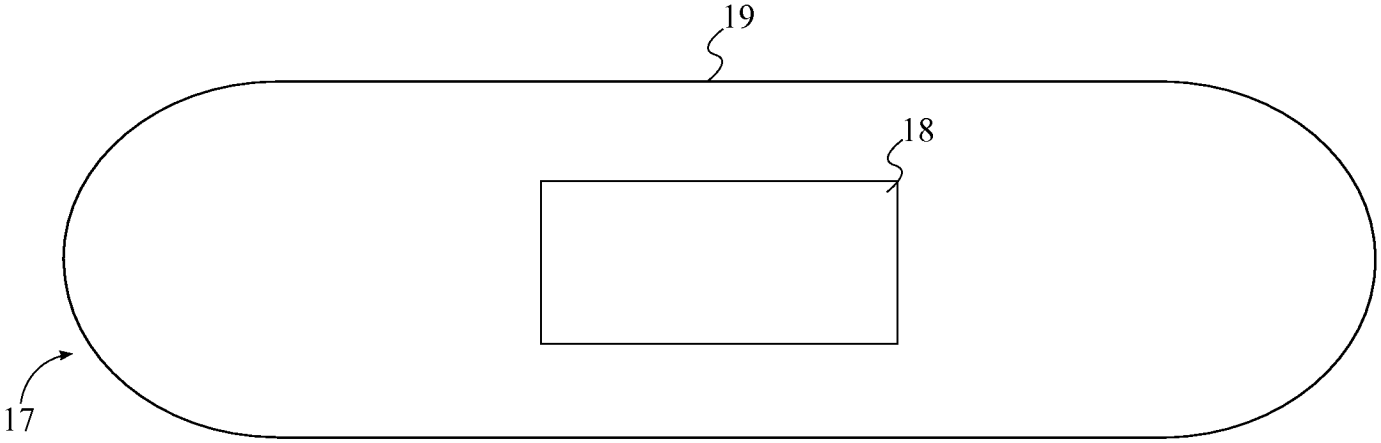
FIG. 8 is a diagrammatic view of an embodiment of the present invention, wherein each of the plurality of laser-combustible microcapsules comprises a laser-ignitable propellant.

With reference to FIG. 8, each of the plurality of laser-combustible microcapsules 17 comprises a laser-ignitable propellant 18 and an optically-translucent housing 19. The laser-ignitable propellant 18 is a combination of chemical compounds that is able to combust upon coming into contact with the laser tunnel due to the intensity and wavelength of the laser tunnel. The laser-ignitable propellant 18 preferably includes, but is not limited to, a fuel, an oxidizer, an accelerator, and a surfactant. The combustion of the laser-ignitable propellant 18 provides the correcting force on the projectile 12 that directs the projectile 12 back toward the center of the laser tunnel. The laser-ignitable propellant 18 is positioned within the optically-translucent housing 19, allowing the plurality of laser-combustible microcapsules 17 to be applied via various means to the projectile 12. The optically-translucent housing 19 allows the plurality of laser-combustible microcapsules 17 to be engaged by the laser tunnel.

Figure 9:
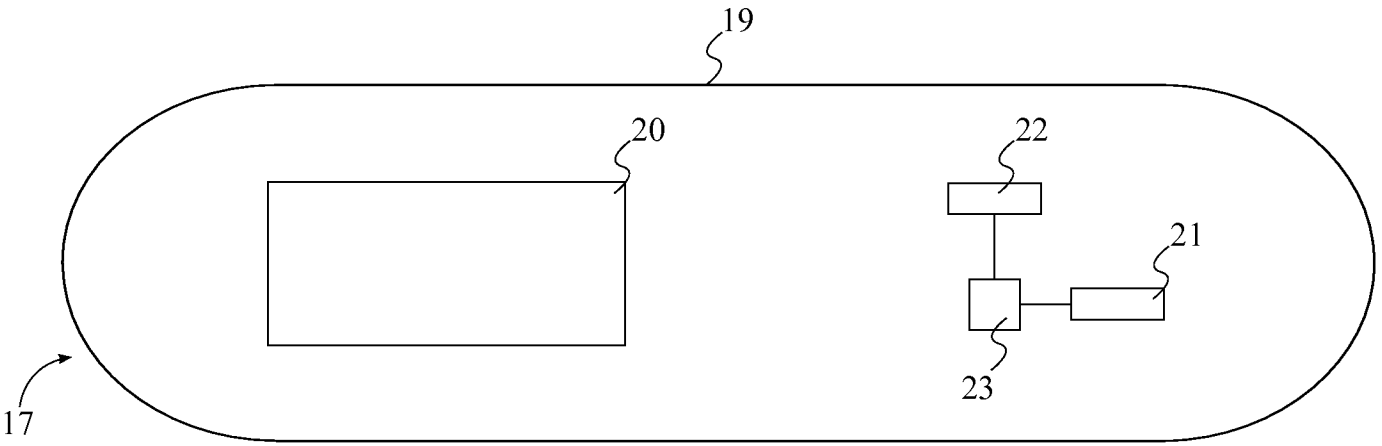
FIG. 9 is a diagrammatic view of an embodiment of the present invention, wherein each of the plurality of laser-combustible microcapsules comprises a laser-stable propellant, an inductively-chargeable capacitor, a laser pulse reader, and a microcontroller.
Figure 10:
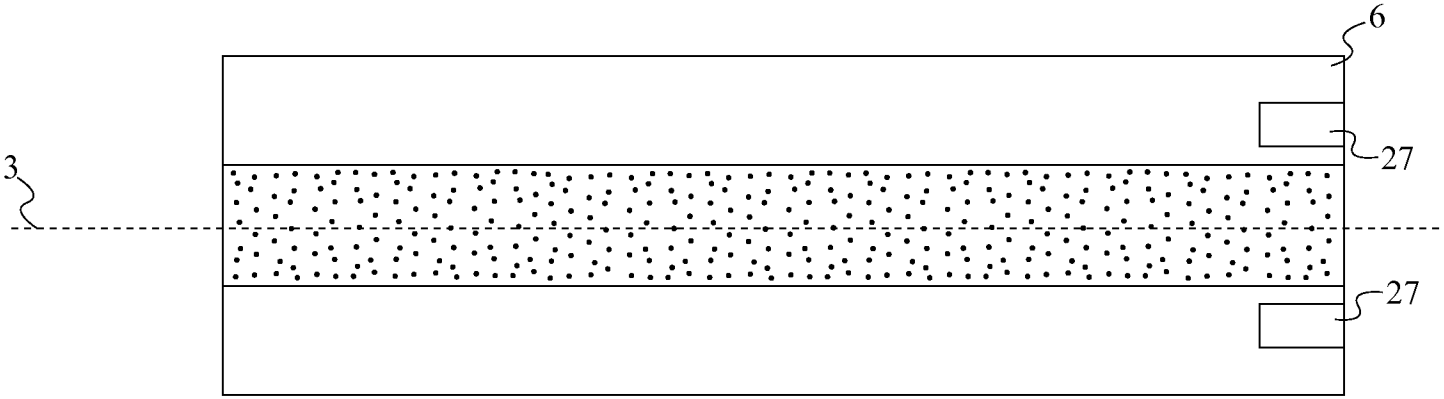
FIG. 10 is a diagrammatic view of the magnetic field generator within the housing sleeve.

Due to the fact that the projectile 12 may be required to travel for a great distance prior to reaching the target, it is possible that the power of the laser tunnel generator assembly 7 may not be sufficient to activate the plurality of laser-combustible microcapsules 17 and guide the projectile 12 to the target due to the diminished power of the laser tunnel generator assembly 7 over distance. With reference to FIG. 9 and FIG. 10, the present invention further comprises a magnetic field generator 27. In the first embodiment of the plurality of laser-combustible microcapsules 17, each of the plurality of laser-combustible microcapsules 17 comprises a laser-stable propellant 20, an optically-translucent housing 19, an inductively-chargeable capacitor 21, a laser pulse reader 22, and a microcontroller 23. The laser-stable propellant 20 is not directly combustible by laser energy. In the first embodiment of the plurality of laser-combustible microcapsules 17, the at least one laser diode 8 operates in a pulsed mode and emits a specific laser digital pulse code that is readable by the laser pulse reader 22. The laser-stable propellant 20 is positioned within the optically-translucent housing 19 while the inductively-chargeable capacitor 21, the laser pulse reader 22, and the microcontroller 23 are mounted within the optically-translucent housing 19 as well. The optically-translucent housing 19 allows the laser pulse reader 22 to read the laser digital pulse code that is emitted by the at least one laser diode 8.

As shown in FIG. 10, the magnetic field generator 27 is positioned within the housing sleeve 6 and generates a magnetic field through which the projectile 12 is able to travel after being discharged from the firearm 1. The generated magnetic field surrounds the central axis 3 of the barrel 2. The rotation of the projectile 12 within the magnetic field generated by the magnetic field generator 27 charges the inductively-chargeable capacitor 21, thus activating the plurality of laser-combustible microcapsules 17. The microcontroller 23 is able to discharge the inductively-chargeable capacitor 21 upon the laser pulse reader 22 reading the specific laser digital pulse code emitted by the at least one laser diode 8. The laser pulse reader 22 is able to read the laser digital pulse code when the projectile comes into contact with the laser tunnel. The laser pulse reader 22 is electronically connected to the microcontroller 23 allowing the microcontroller 23 to begin discharging the inductively-chargeable capacitor 21 once the laser pulse reader 22 reads the laser digital pulse code emitted by the at least one laser diode 8. The microcontroller 23 is electrically connected to the inductively-chargeable capacitor 21. When the inductively-chargeable capacitor 21 is discharged, an electric spark is produced that ignites the laser-stable propellant 20, generating the plurality of explosive outputs 16 that corrects the flight trajectory of the projectile 12. The inductively-chargeable capacitor 21 is positioned adjacent to the laser-stable propellant 20 to allow the electric spark to engage the laser-stable propellant 20. This is effective when attempting to strike a target at a great distance due to the fact that the power of the laser tunnel generator assembly 7 is very weak. The laser digital pulse code is able to control the flight trajectory of the projectile 12 when the power of the laser tunnel generator assembly 7 is insufficient.

Figure 11:
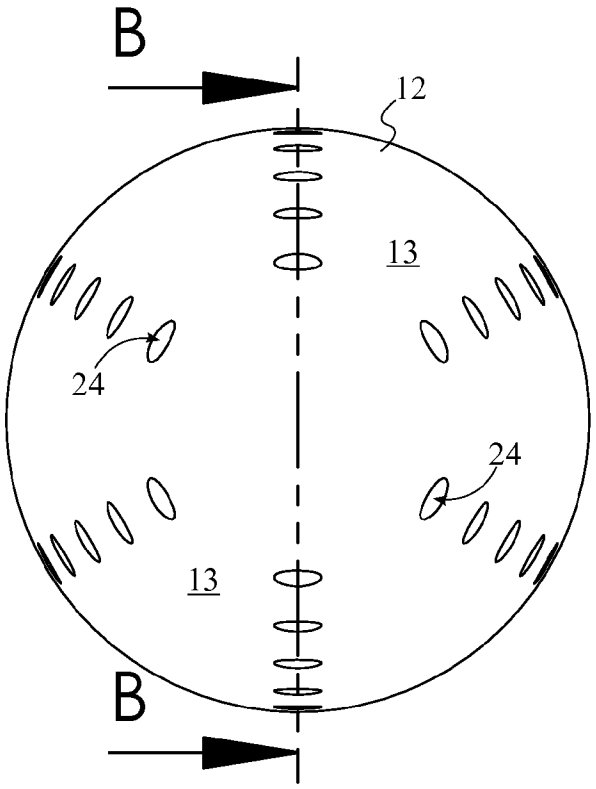
FIG. 11 is a front view of an embodiment of the present invention, wherein a plurality of gas ventilation holes is present on the projectile.
Figure 12:
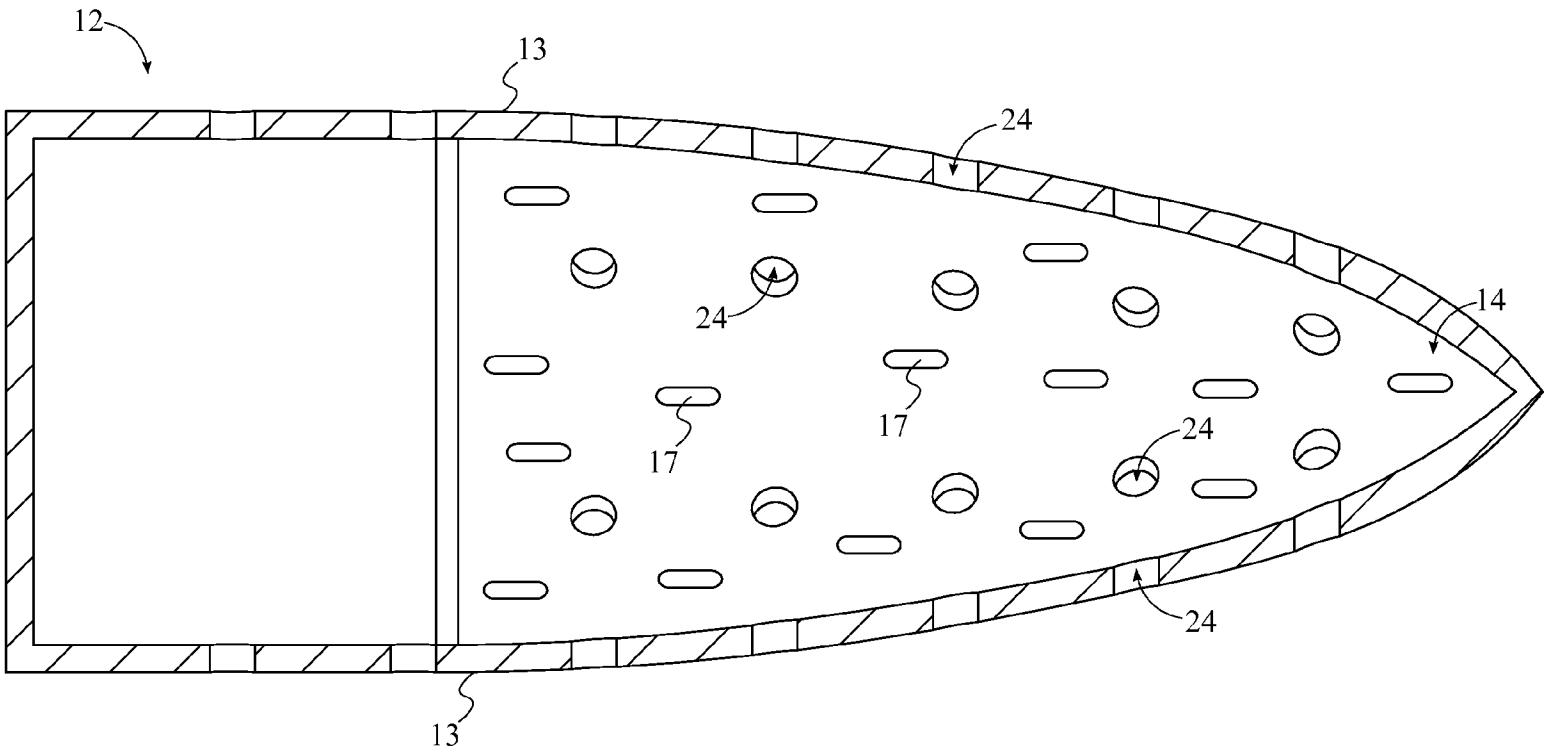
FIG. 12 is a longitudinal-sectional view of the present invention taken along line B-B of FIG. 11, wherein the plurality of laser-combustible microcapsules is enclosed within a housing cavity of the projectile.

In the second embodiment of the plurality of laser-combustible microcapsules 17 shown in FIG. 11 and FIG. 12, the trajectory-correcting actuator 15 comprises a plurality of laser-combustible microcapsules 17 and a plurality of gas ventilation holes 24. In the second embodiment of the plurality of laser-combustible microcapsules 17, the plurality of laser-combustible microcapsules 17 is enclosed within a housing cavity 14 of the projectile 12. The plurality of gas ventilation holes 24 allows gas produced during combustion of the plurality of laser-combustible microcapsules 17 to escape from the housing cavity 14. The plurality of explosive outputs 16 is thus able to correct the flight trajectory of the projectile 12. The plurality of gas ventilation holes 24 traverses through the projectile 12 and into the housing cavity 14, allowing gas from the plurality of explosive outputs 16 to escape from within the housing cavity 14 to the external environment after the plurality of laser-combustible microcapsules 17 is ignited. The plurality of gas ventilation holes 24 is distributed about the aerodynamic portion 13 of the projectile 12, allowing the gas to escape from the housing cavity 14 at numerous positions along the aerodynamic portion 13 and increasing the capacity for the plurality of explosive outputs 16 to correct the flight trajectory of the projectile 12.

The second embodiment of the plurality of laser-combustible microcapsules 17 shown in FIG. 11 and FIG. 12 may be directly ignited by the light emitted by the at least one laser diode 8. In this case, each of the plurality of laser-combustible microcapsules 17 comprises a laser-ignitable propellant 18 and an optically-translucent housing 19. The laser-ignitable propellant 18 preferably includes, but is not limited to, a fuel, an oxidizer, an accelerator, and a surfactant. The optically-translucent housing 19 allows the plurality of laser-combustible microcapsules 17 to be engaged by the laser tunnel when the projectile 12 comes into contact with the laser tunnel. When the projectile 12 comes into contact with the laser tunnel, the laser-ignitable propellant 18 within the optically-translucent housing 19 is ignited and the plurality of explosive outputs 16 is able to correct the flight trajectory of the projectile 12. Gas from the plurality of explosive outputs 16 is able to escape from the housing cavity 14 through the plurality of gas ventilation holes 24.

The second embodiment of the plurality of laser-combustible microcapsules 17 within the housing cavity 14 may be engaged by the magnetic field generator 27 as well. Each of the plurality of laser-combustible microcapsules 17 comprises a laser-stable propellant 20, an optically-translucent housing 19, an inductively-chargeable capacitor 21, a laser pulse reader 22, and a microcontroller 23. The laser-stable propellant 20 is not directly combustible by laser energy and is engaged when the laser pulse reader 22 detects the specific laser digital pulse code that is emitted by the at least one laser diode 8. As before, the inductively-chargeable capacitor 21 is charged as the projectile 12 rotates during flight while traveling through the magnetic field generated by the magnetic field generator 27. The laser-stable propellant 20 is positioned within the optically-translucent housing 19 along with the inductively-chargeable capacitor 21, the laser pulse reader 22, and the microcontroller 23. When the laser-stable propellant 20 is engaged by discharging the inductively-chargeable capacitor 21, gas is able to escape through the plurality of gas ventilation holes 24.

Figure 13:
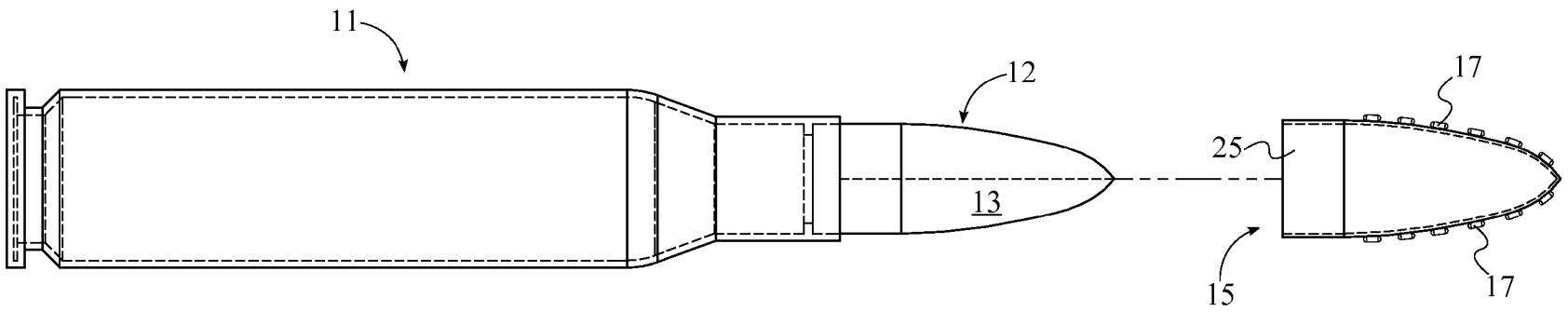
FIG. 13 is a side view of an embodiment of the present invention, wherein the plurality of laser-combustible microcapsules is externally layered onto a cap and the aerodynamic portion of the projectile is sheathed by the cap.

In the third embodiment of the plurality of laser-combustible microcapsules 17 shown in FIG. 13, the trajectory-correcting actuator 15 comprises a plurality of laser-combustible microcapsules 17 and a cap 25. The cap 25 is prefabricated and allows the plurality of laser-combustible microcapsules 17 to be utilized without applying the plurality of laser-combustible microcapsules 17 directly to the projectile 12. The aerodynamic portion 13 of the projectile 12 is sheathed by the cap 25, allowing the cap 25 to easily be retrofitted to the projectile 12. The plurality of laser-combustible microcapsules 17 is externally layered onto the cap 25, forming a coating of the plurality of laser-combustible microcapsules 17 on the cap 25. The ignition of the plurality of laser-combustible microcapsules 17 in the third embodiment of the present invention may be initiated by contact between the projectile 12 and the laser tunnel or by the discharge of the inductively-chargeable capacitor 21.

The plurality of laser-combustible microcapsules 17 externally layered onto the cap 25 may be ignited directly by the light emitted by the at least one laser diode 8. When the projectile 12 comes into contact with the laser tunnel, the plurality of laser-combustible microcapsules 17 on the cap 25 are ignited, thus correcting the flight trajectory of the projectile 12. Each of the plurality of laser-combustible microcapsules 17 comprises a laser-ignitable propellant 18 and an optically-translucent housing 19. The laser-ignitable propellant 18 is positioned within the optically-translucent housing 19, allowing the light emitted by the at least one laser diode 8 to engage the laser-ignitable propellant 18.

The plurality of laser-combustible microcapsules 17 on the cap 25 may be engaged by the magnetic field generator 27 as well. Each of the plurality of laser-combustible microcapsules 17 comprises a laser-stable propellant 20, an optically-translucent housing 19, an inductively-chargeable capacitor 21, a laser pulse reader 22, and a microcontroller 23. The inductively-chargeable capacitor 21 is charged as the projectile 12 rotates while traveling through the magnetic field generated by the magnetic field generator 27. When the projectile 12 comes into contact with the laser tunnel, the laser pulse reader 22 is able to read the specific laser digital pulse code that is emitted by the at least one laser diode 8. The inductively-chargeable capacitor 21 is discharged and the plurality of laser-combustible microcapsules 17 on the cap 27 is ignited, correcting the flight trajectory of the projectile 12.

Again with reference to FIG. 1 and FIG. 2, the present invention further comprises a calibration laser 26. The calibration laser 26 is utilized to adjust the laser tunnel generator assembly 7 and a scope that is attached to the firearm 1 in order to ensure that the projectile 12 is able to strike the desired target. The calibration laser 26 may be an infrared laser or similar laser. The calibration laser 26 is laterally mounted onto the housing sleeve 6 in order to place the calibration laser 26 in close proximity with the laser tunnel generator assembly 7. An emission direction 28 of the calibration laser 26 is oriented parallel to the central axis 3 of the barrel 2. This ensures that the calibration laser 26 is oriented away from the firearm 1 and in the direction in which the projectile 12 is discharged.

Figure 14:
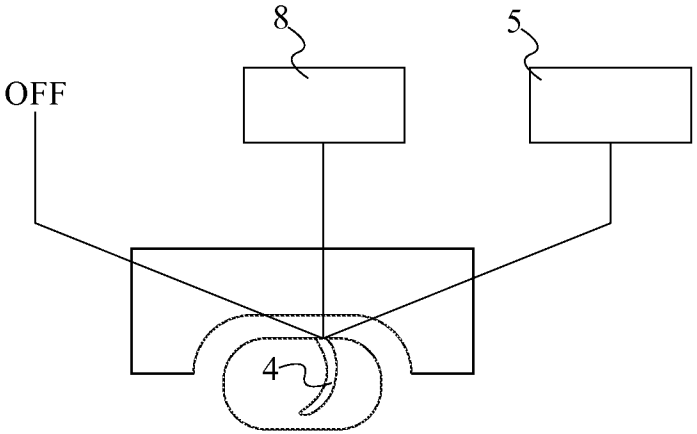
FIG. 14 is a diagrammatic view of the electronic and mechanical connections between the multi-stage trigger, the firing assembly, and the at least one laser diode.
Figure 15:
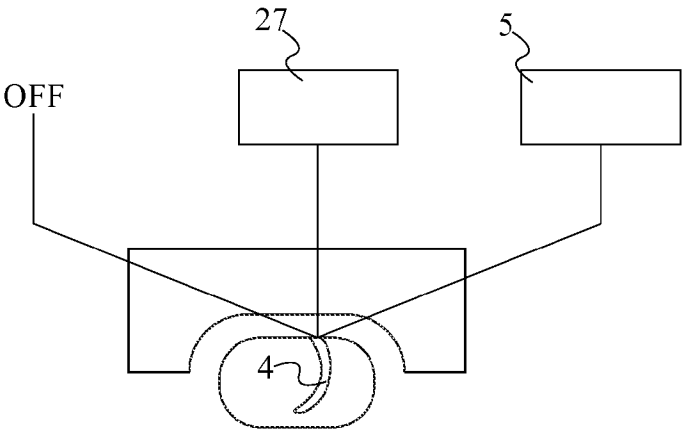
FIG. 15 is a diagrammatic view of the electronic and mechanical connections between the multi-stage trigger, the firing assembly, and the magnetic field generator.

With reference to FIG. 14 and FIG. 15, the firearm 1 comprises a multi-stage trigger 4 and a firing assembly 5. The multi-stage trigger 4 is able to perform the dual functions of activating the laser tunnel generator assembly 7 and discharging the firearm 1. As such, the multi-stage trigger 4 is electronically connected to the at least one laser diode 8. Additionally, the multi-stage trigger 4 is mechanically coupled to the firing assembly 5. As shown in FIG. 14, the multi-stage trigger 4 is partially actuated in order to activate the at least one laser diode 8 and emit the laser tunnel. The multi-stage trigger 4 is then fully actuated in order to discharge the firearm 1. As shown in FIG. 15, the multi-stage trigger 4 is also electronically connected to the magnetic field generator 27 and mechanically coupled to the firing assembly 5. When the magnetic field generator 27 is in use, the multi-stage trigger 4 is partially actuated in order to generate the magnetic field and is fully actuated in order to discharge the firearm 1.

Prior to attempting to strike a target, the firearm 1 is sighted utilizing the laser tunnel generator assembly 7 and the calibration laser 26. The calibration laser 26 and the at least one laser diode 8 are first activated and the user looks through the scope of the firearm 1. As previously discussed, the at least one laser diode 8 is activated by partially actuating the multi-stage trigger 4. Once the desired target is acquired, the laser tunnel generator assembly 7 is adjusted in order to ensure that the emitted laser tunnel is positioned on the target with the calibration laser 26 positioned within the center of the laser tunnel. The scope of the firearm 1 is then adjusted to center the scope reticle on the calibration laser 26 and the center of the laser tunnel. The user may then discharge the firearm 1 by fully actuating the multi-stage trigger 4. The laser tunnel remains activated so long as the multi-stage trigger 4 is partially or fully actuated.

Once the projectile 12 is discharged from the firearm 1, the projectile 12 initially follows a flight trajectory within the laser tunnel that is in line with the central axis 3 of the barrel 2. The multi-stage trigger 4 is held in an actuated position in order to keep the at least one laser diode 8 activated. As external and internal ballistic factors begin to affect the flight trajectory of the projectile 12, the projectile 12 comes into contact with the laser tunnel. When this occurs, the plurality of laser-combustible microcapsules 17 is ignited and the resulting plurality of explosive outputs 16 causes the projectile 12 to be directed back toward the center of the laser tunnel. The projectile 12 is continuously directed back toward the center of the laser tunnel when the external and internal ballistic factors cause the projectile 12 to come into contact with the laser tunnel and the process is repeated until the projectile 12 reaches the target. Additionally, if the laser tunnel is moved while the projectile 12 is traveling to the target, the projectile 12 is able to follow a curved trajectory in any direction to the target. This is particularly suitable if the target has moved since the projectile 12 was discharged.

Over long distances where the power of the at least one laser diode 8 is not sufficient to ignite the plurality of laser-combustible microcapsules 17, the magnetic field generator 27 and the laser tunnel generator assembly 7 are both utilized to guide the projectile 12. Once the projectile 12 is discharged, the projectile 12 initially follows a flight trajectory within the magnetic field that is in line with the central axis 3 of the barrel 2. The rotation of the projectile 12 within the magnetic field during flight charges the inductively-chargeable capacitor 21 and activates the plurality of laser-combustible microcapsules 17. The multi-stage trigger 4 is held actuated in order to keep the magnetic field generator 27 activated. The laser pulse reader 22 is able to read the specific laser digital pulse code emitted by the at least one laser diode 8 when the projectile 12 comes into contact with the laser tunnel. This causes the microcontroller 23 to discharge the inductively-chargeable capacitor 21, producing an electric spark that ignites the laser-stable propellant 20 and generating the plurality of explosive outputs 16 that corrects the flight trajectory of the projectile 12. This process is repeated if the projectile 12 comes into further contact with the laser tunnel while traveling to the target.

The present invention allows the user to engage a target without being required to calculate and compensate for external and internal ballistic factors that may affect flight trajectory such as gravity, drag, crosswinds, and air density. The external and internal ballistic factors are automatically compensated for by the plurality of explosive outputs 16 upon the projectile 12 coming into contact with the laser tunnel, allowing the user to simply aim at the target and discharge the firearm 1. Extant firearms, accessories, and ammunition require little to no modification in order to be utilized with the present invention as well.

Although the present invention has been explained in relation to its preferred embodiment, it is understood that many other possible modifications and variations can be made without departing from the spirit and scope of the present invention as hereinafter claimed.

What is claimed is:

1. A laser-guided projectile system comprises:
- a firearm;
- a housing sleeve;
- a laser tunnel generator assembly;
- a cartridge;
- a trajectory-correcting actuator;
- the cartridge comprises a projectile;
- the laser tunnel generator assembly comprises an at least one laser diode and a fiber optic dispersion array;
- the housing sleeve being concentrically mounted to a barrel of the firearm;
- the laser tunnel generator assembly being positioned within the housing sleeve;
- the at least one laser diode being optically connected into the fiber optic dispersion array;
- the fiber optic dispersion array being laterally positioned around the barrel;
- a plurality of explosive outputs for the trajectory-correcting actuator being evenly distributed about an aerodynamic portion of the projectile;
- the cartridge being concentrically positioned along a central axis of the barrel; and
- an emission direction of the fiber optic dispersion array being oriented parallel to the central axis of the barrel.

2. The laser-guided projectile system as claimed in claim 1 further comprises:
- the trajectory-correcting actuator comprises a plurality of laser-combustible microcapsules; and
- the plurality of laser-combustible microcapsules being externally layered onto the aerodynamic portion of the projectile.

3. The laser-guided projectile system as claimed in claim 2 further comprises:
- each of the plurality of laser-combustible microcapsules comprises a laser-ignitable propellant and an optically-translucent housing; and
- the laser-ignitable propellant being positioned within the optically-translucent housing.

4. The laser-guided projectile system as claimed in claim 2 further comprises:

a magnetic field generator;

each of the plurality of laser-combustible microcapsules comprises a laser-stable propellant, an optically-translucent housing, an inductively-chargeable capacitor, a laser pulse reader, and a microcontroller;

the magnetic field generator being positioned within the housing sleeve;

the laser-stable propellant being positioned within the optically-translucent housing;

the inductively-chargeable capacitor, the laser pulse reader, and the microcontroller being mounted within the optically-translucent housing;

the laser pulse reader being electronically connected to the microcontroller; and the microcontroller being electrically connected to the inductively-chargeable capacitor.

5. The laser-guided projectile system as claimed in claim 1 further comprises:

the trajectory-correcting actuator comprises a plurality of laser-combustible microcapsules and a plurality of gas ventilation holes;

the plurality of laser-combustible microcapsules being enclosed within a housing cavity of the projectile;

the plurality of gas ventilation holes traversing through the projectile and into the housing cavity; and the plurality of gas ventilation holes being distributed about the aerodynamic portion of the projectile.

6. The laser-guided projectile system as claimed in claim 5 further comprises:

each of the plurality of laser-combustible microcapsules comprises a laser-ignitable propellant and an optically-translucent housing; and the laser-ignitable propellant being positioned within the optically-translucent housing.

7. The laser-guided projectile system as claimed in claim 5 further comprises:

a magnetic field generator;

each of the plurality of laser-combustible microcapsules comprises a laser-stable propellant, an optically-translucent housing, an inductively-chargeable capacitor, a laser pulse reader, and a microcontroller;

the magnetic field generator being positioned within the housing sleeve;

the laser-stable propellant being positioned within the optically-translucent housing;

the inductively-chargeable capacitor, the laser pulse reader, and the microcontroller being mounted within the optically-translucent housing;

the laser pulse reader being electronically connected to the microcontroller; and the microcontroller being electrically connected to the inductively-chargeable capacitor.

8. The laser-guided projectile system as claimed in claim 1 further comprises:

the trajectory-correcting actuator comprises a plurality of laser-combustible microcapsules and a cap;

the aerodynamic portion of the projectile being sheathed by the cap; and the plurality of laser-combustible microcapsules being externally layered onto the cap.

9. The laser-guided projectile system as claimed in claim 8 further comprises:

each of the plurality of laser-combustible microcapsules comprises a laser-ignitable propellant and an optically-translucent housing; and the laser-ignitable propellant being positioned within the optically-translucent housing.

10. The laser-guided projectile system as claimed in claim 8 further comprises:

a magnetic field generator;

each of the plurality of laser-combustible microcapsules comprises a laser-stable propellant, an optically-translucent housing, an inductively-chargeable capacitor, a laser pulse reader, and a microcontroller;

the magnetic field generator being positioned within the housing sleeve;

the laser-stable propellant being positioned within the optically-translucent housing;

the inductively-chargeable capacitor, the laser pulse reader, and the microcontroller being mounted within the optically-translucent housing;

the laser pulse reader being electronically connected to the microcontroller; and the microcontroller being electrically connected to the inductively-chargeable capacitor.

11. The laser-guided projectile system as claimed in claim 1 further comprises:

a calibration laser;

the calibration laser being laterally mounted onto the housing sleeve; and an emission direction of the calibration laser being oriented parallel to the central axis of the barrel.

12. The laser-guided projectile system as claimed in claim 1 further comprises:

the firearm comprises a multi-stage trigger and a firing assembly;

the multi-stage trigger being electronically connected to the at least one laser diode; and the multi-stage trigger being mechanically coupled to the firing assembly.

13. The laser-guided projectile system as claimed in claim 1 further comprises:

a magnetic field generator;

the firearm comprises a multi-stage trigger and a firing assembly;

the multi-stage trigger being electronically connected to the magnetic field generator; and the multi-stage trigger being mechanically coupled to the firing assembly.

* * * * *